US005310013A

United States Patent [19]

Kishino et al.

[11] Patent Number: 5,310,013

[45] Date of Patent: May 10, 1994

[54] CORE MARKING SYSTEM FOR A SIDEWALL CORING TOOL

[75] Inventors: Ashley C. Kishino, Houston, Tex.; David O. Turner, Oklahoma City, Okla.

[73] Assignee: Schlumberger Technology Corporation, Houston, Tex.

[21] Appl. No.: 935,090

[22] Filed: Aug. 24, 1992

[51] Int. Cl.[5] ..... E21B 25/16

[52] U.S. Cl. ..... 175/44; 175/58; 175/244

[58] Field of Search ..... 175/20, 44, 58, 244, 175/603; 221/212

[56] References Cited

U.S. PATENT DOCUMENTS

| | | | |
|---|---|---|---|
| 3,889,765 | 6/1975 | Henson | 175/257 |
| 4,128,134 | 12/1978 | Gregory | 175/44 |
| 4,311,201 | 1/1982 | Stewart et al. | 175/44 |
| 4,354,558 | 10/1982 | Jageler et al. . | |
| 4,449,593 | 5/1984 | Jageler et al. . | |
| 4,461,360 | 7/1984 | Mount, II . | |
| 4,466,495 | 8/1984 | Jageler . | |
| 4,714,119 | 12/1987 | Hebert et al. . | |
| 5,067,763 | 11/1991 | Aoyama | 221/212 X |
| 5,096,091 | 3/1992 | Heu | 221/212 |

*Primary Examiner*—William P. Neuder

*Attorney, Agent, or Firm*—Henry N. Garrana; John H. Bouchard

[57] ABSTRACT

A system for reliably indexing and separating sidewall core samples obtained with a sidewall coring tool comprises markers made of a magnetic material and a mechanism body made of a combination of magnetic and non-magnetic materials to reliably insert and position markers in between successive core samples. The sidewall core is not altered in any way by the marking process. Further, a flexible rubber boot apparatus is disclosed to ensure the complete transfer of retrieved samples in cases where the sample is broken, shattered or segmented and to ensure that broken, shattered or segmented cores will be retrieved in cases where the borehole is horizontal and the tool must operate in a horizontal position or in any other rotational orientation.

21 Claims, 5 Drawing Sheets

CORE MARKING SYSTEM FOR A SIDEWALL CORING TOOL

BACKGROUND OF THE INVENTION

The subject matter of the present invention relates to an improved core marking system for a borehole sidewall coring tool adapted for use in a wellbore.

Sidewall coring tools are used for the purpose of obtaining a sample of a formation traversed by a wellbore. In the following discussion, the terms "sample", "sidewall core", "core sample" and "core" are used interchangeably. In each sidewall coring tool, a marker system is used to mark each sample of the formation in order to obtain an indication of the depth of the sample in the wellbore. For example, U.S. Pat. No. 4,714,119 to Hebert et al, which issued Dec. 22, 1987 (hereinafter referred to as "the Hebert patent") is directed to a sidewall coring tool that is adapted for cutting and obtaining sidewall cores of a formation traversed by the borehole, the direction of the cut being perpendicular to an axis of the borehole. The disclosure of the Hebert patent is incorporated by reference into this specification. However, although the marker system used in connection with the Hebert patent has performed adequately, a need has arisen for an improved, more reliable marker system for use in connection with borehole sidewall coring tools.

The proper operation of a marker or indexing system is important because it is the principal method by which the retrieved sidewall samples are identified and correlated to the depths at which they were taken. Failure to properly identify the cores leads to the loss of all retrieved samples, since the interpretation, analysis and information concerning the retrieved samples is of value only when the correct depth of origin is known. If the depth of origin of one sample is unknown, the origins of all of the samples become subject to question.

Therefore, the potential for failure of the entire operation exists when the marking system malfunctions. In a horizontal wellbore, such a service might not even be attempted if it was believed that no indexing system would be present or available. Typical operational problems, encountered by the operators of a sidewall coring tool, are high borehole fluid density and high borehole fluid viscosity. In gravity feed marking systems, such as those described in U.S. Pat. Nos. 4,449,593 and 4,714,119, proper functioning of the tool relies on having the marker fall into a core storage tube or vessel driven exclusively by the force of gravity. However, fluid densities can be high (sometimes in excess of twice the density of water). As the difference in the fluid density and the marker's density decreases, the buoyancy of the marker increases, and the tendency of the marker to fall decreases. High fluid viscosity is a more significant problem when the viscosity is high. The fluid is essentially a thick gel, and the markers as described in U.S. Pat. Nos. 4,449,593 and 4,714,119 are being held in suspension by the high viscosity fluid. This leads to erroneous placement or lack of placement of markers and subsequent improper indexing of core samples. This combination of high fluid density and high viscosity, which is commonly encountered, can prevent the marker from dropping at all. In high viscosity conditions, the markers tend to stick to the marker kicker and may be retracted when the marker kicker retracts. Examples of marker kicker devices are shown in U.S. Pat. No. 4,714,119 (element 65, "kicker foot") and U.S. Pat. No. 4,449,593 (element 72, "wafer ejector"). The problems presented by borehole fluid conditions exist in both horizontal and vertical tool positions. All of the above problems have been routinely cited by operating field locations as problems which they encounter during field operations.

Another problem involves the debris which exists in and around the core storage area. Debris in the well bore can be present in the form of rock cuttings from the borehole drilling process left in suspension in the borehole fluid or rock fragments knocked loose from the borehole wall by the motion of the entire apparatus. In addition, the drilling of the sidewall sample itself produces debris. Debris obstructions in the area leading to the core storage area can prevent recovery of the sidewall sample. Further, debris can also impede the delivery of the marker to the core storage area if the debris accumulates in front of the marker itself. This prevents the marker from being moved to the proper position. In addition, debris inside the core storage tube occupies space which is designated for core storage, reducing the maximum number of samples which can be recovered.

It has been found that the recovery from an oil well can be substantially increased in some cases by making the wellbore horizontal in the section of the well which will produce the petroleum. Recent improvements in the methods and practices for drilling of wells with horizontal boreholes have allowed horizontal drilling to become much more common place than was previously the case. It is common practice to refer to the well bore deviation with reference to the surface of the earth, so that well bores perpendicular to the surface of the earth are said to be vertical. In the course of evaluation of these wells, it is expected that most wireline formation evaluation tools must be able to operate in a horizontal position. Positioning the tool horizontally presents a new set of problems in addition to those posed by borehole fluid conditions. The system, used by the devices described in U.S. Pat. Nos. 4,449,593 and 4,714,119, has two problems: first, horizontal positioning removes the gravity force required to move the marker into the core storage tube; in these systems, the marker can either fall sideways away from the funnel as it is moved by the marker kicking device or it could fall into the funnel, and, depending on the angular orientation of the tool, fall out of the funnel into the borehole; and second, with the tool mechanism in the horizontal position, pieces of segmented, broken or fragmented cores are lost as the core is being directed to the core tube by the core pusher assembly. For the purposes of evaluation and analysis of the core, it is desirable to have as much of the core sample as possible. In addition, pieces of the core which fall out could jam the mechanism and prevent core removal. Segmented, broken and fragmented cores are observed reasonably frequently during sidewall coring operations. The condition of the core cannot be predicted, nor can it be assumed that recovered cores will be in one piece since the reasons for broken cores are also varying and unpredictable.

Thus a properly functioning marking system is critical for wellsite operations in order to ensure that the sidewall coring tool can be considered for use in the maximum number of potential applications and in different situations. In addition, it is important in all situations that as much of the core be recovered as possible to allow for the optimal analysis of recovered samples.

As a result, the need exists for an improved core marking system for use with a sidewall coring tool, which core marking system will reliably mark, index, and separate both whole and fragmented sidewall core samples regardless of the deviation of the wellbore in which the sidewall coring tool is disposed.

SUMMARY OF THE INVENTION

Accordingly, it is a primary object of the present invention to provide an improved core marking system for a sidewall coring tool, which core marking system will reliably mark, index, and separate both whole and fragmented sidewall core samples regardless of the deviation of the wellbore in which the sidewall coring tool is disposed.

It is a further object of the present invention to provide an improved core marking system for a sidewall coring tool, which core marking system includes an adaptor block constructed of a magnetic material and utilizing a plurality of marker discs, each disc being made of a permanently magnetic material.

It is a further object of the present invention to provide an improved sidewall coring tool which includes the improved core marking system, the improved core marking system including the adaptor block made of magnetic material and the marker discs made of permanently magnetic material, the improved sidewall coring tool including a flexible rubber boot connected to a core storage tube which is disposed in direct alignment with a core barrel out of which the core or formation sample is pushed, the direct alignment of the rubber boot and associated core storage tube with the core barrel creating, in effect, a continuous tube from the core barrel to the core storage tube for passage of the formation sample from the core barrel to the core storage tube.

In accordance with these and other objects of the present invention, U.S. Pat. No. 4,714,119 to Hebert et al (the "Hebert patent"), already incorporated herein by reference, describes a sidewall coring tool which is capable of cutting core samples from the sidewall of a borehole; a core drilling mechanism of the sidewall coring tool is disposed in an elongate housing and is rotated from a vertical storage position to a horizontal operational position. In a significant improvement to the core marking system of the Hebert patent, marker discs made from a permanently magnetic material are used in conjunction with an adaptor block which is also constructed of a magnetic material and including a sleeve of non-magnetic material fitted internally. The magnetic marker discs are pulled by magnetic force into the magnetic adaptor block and fall into a core storage tube. The marker discs are permanent magnets with high magnetic field strength. This field strength can overcome the effects of high borehole fluid density, high fluid viscosity and lack of gravitational pull when the sidewall coring tool is disposed on its side in a deviated borehole. The force exerted on the marker discs resultant from the interaction of the magnetic fields of the marker discs and the adaptor block exceeds the gravitational force on the marker discs. As a result, the core marking system of the present invention performs acceptably and reliably regardless of the deviation of the wellbore in which the sidewall coring tool is disposed. The reliable kicking of the magnetic marker discs by the core marking system of the present invention ensures the retrieval of the markers even when the tool is in a horizontal position; in addition, the markers will not fall out of or away from the core storage tube. The magnetic marker, after it has pulled into the adapter, also serves to prevent the cores previously stored from moving out of the core storage tube. In addition, a flexible rubber boot lines up with the core barrel when the core is being pushed out of the core barrel. The clearance between the rubber and the end of the drilling bit is small, there being no large spaces through which pieces of the core sample can fall when the core is being transferred from the core barrel to the core storage tube. As a result of the boot, a continuous tube exists from the core barrel to the core storage tube. The boot is flexible so that a close fit with the core bit can be achieved without impeding the travel of the core bit in either direction of its motion. Even if a portion of the sidewall core is protruding from the core barrel, the boot will deform to allow passage of the sample as the bit swings back, the boot returning to its original shape. If the boot were made of a solid rigid material, well bore cuttings and debris could easily jam the bit against the boot and restrict bit motion. The boot has the additional benefit, in both vertical and horizontal orientations, that it will exclude debris from the opening leading to the core storage tube. The magnetic markers and flexible rubber boot are not interdependent, in that, should one feature be unavailable, the other will still function. Optimal tool functioning is obtained with both features in place.

Further scope of applicability of the present invention will become apparent from the detailed description presented hereinafter. It should be understood, however, that the detailed description and the specific examples, while representing a preferred embodiment of the present invention, are given by way of illustration only, since various changes and modifications within the spirit and scope of the invention will become obvious to one skilled in the art from a reading of the following detailed description.

BRIEF DESCRIPTION OF THE DRAWINGS

A full understanding of the present invention will be obtained from the detailed description of the preferred embodiment presented hereinbelow, and the accompanying drawings, which are given by way of illustration only and are not intended to be limitative of the present invention, and wherein.

DETAILED DESCRIPTION OF THE PREFERRED EMBODIMENT

Figure 1:
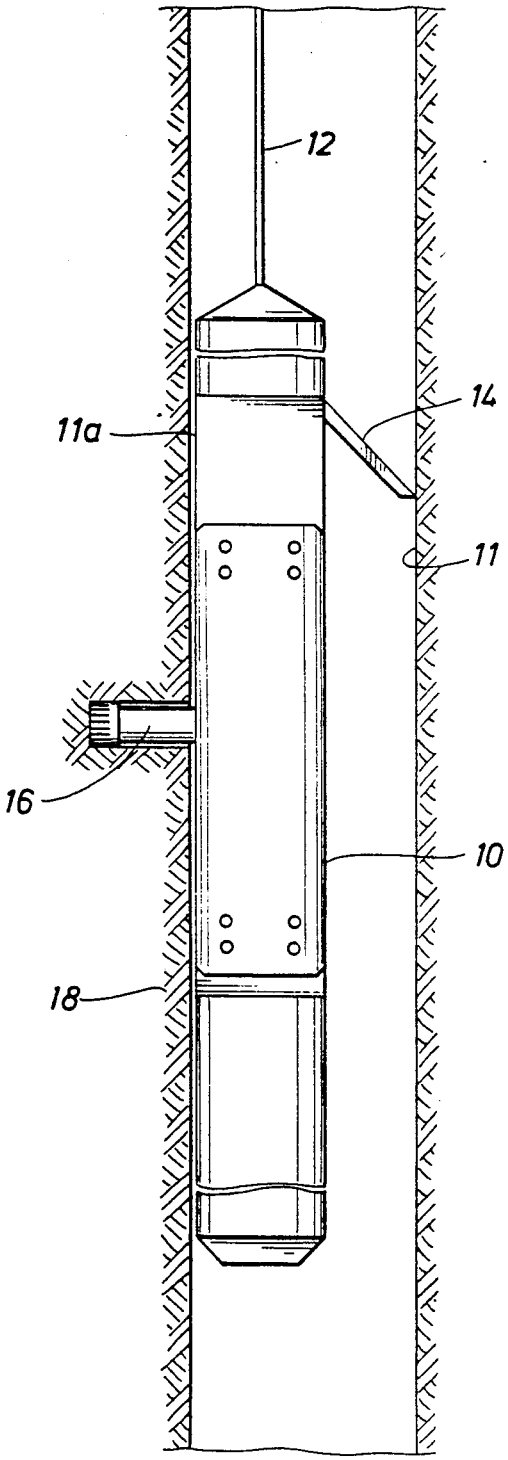
FIG. 1 illustrates a side view of a conventional sidewall coring tool, the tool being shown after having completely drilled a core sample but prior to having broken off and retrieved the sample.

Referring to FIG. 1, a side view of a prior art sidewall coring tool is illustrated.

In FIG. 1, a sidewall coring tool 10 is lowered into a wellbore 11 by a wireline 12. When an anchor shoe 14 is extended, the coring tool 10 contacts a wall 11*a* of the wellbore 11. A coring motor, which includes a drilling bit 16, is rotated thereby moving the drilling bit 16 from its original vertically disposed position to a horizontally disposed position as shown in FIG. 1. The drilling bit 16 drills into the formation 18 thereby collecting a core sample of the formation. The prior art sidewall coring tool 10 of FIG. 1 is fully described in U.S. Pat. No. 4,714,119 to Hebert et al, the disclosure of which has already been incorporated by reference into this specification.

Figure 2:
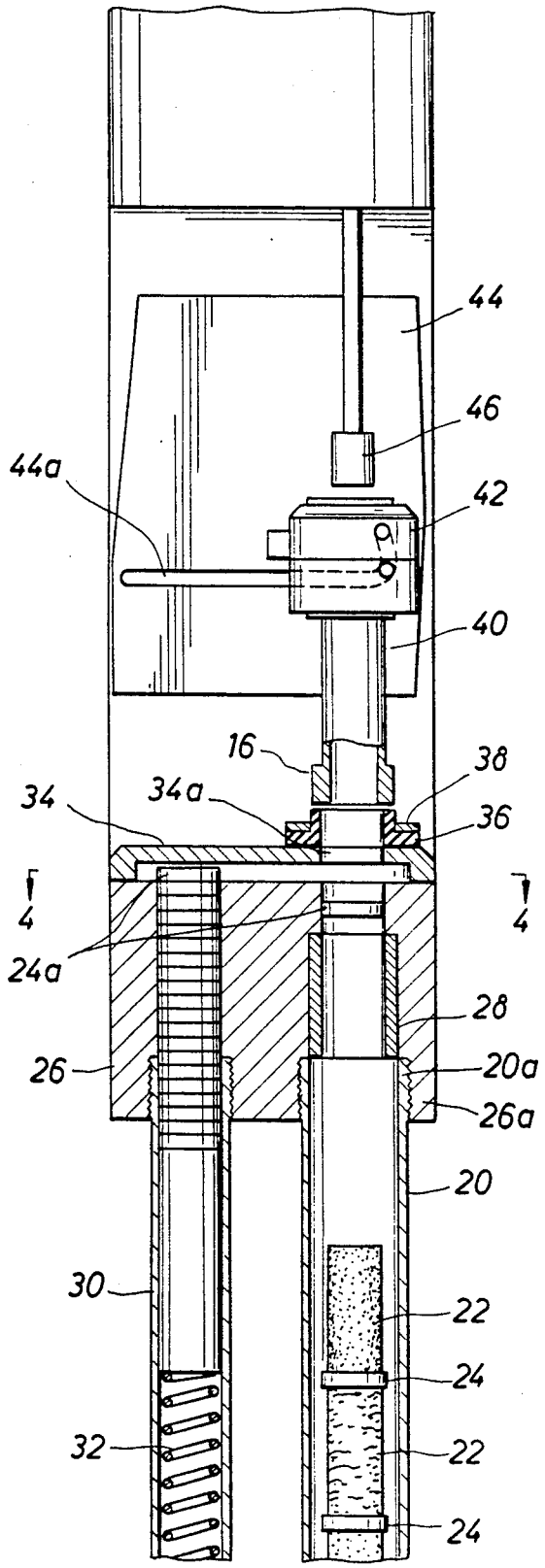
FIG. 2 illustrates a cross sectional view of the sidewall coring tool of FIG. 1 when the coring motor of such coring tool is retracted, the illustrated features of FIG. 2 being placed in the same plane for ease of illustration since the illustrated features are not necessarily placed in the same plane with respect to each other in the actual coring tool apparatus.
Figure 3:
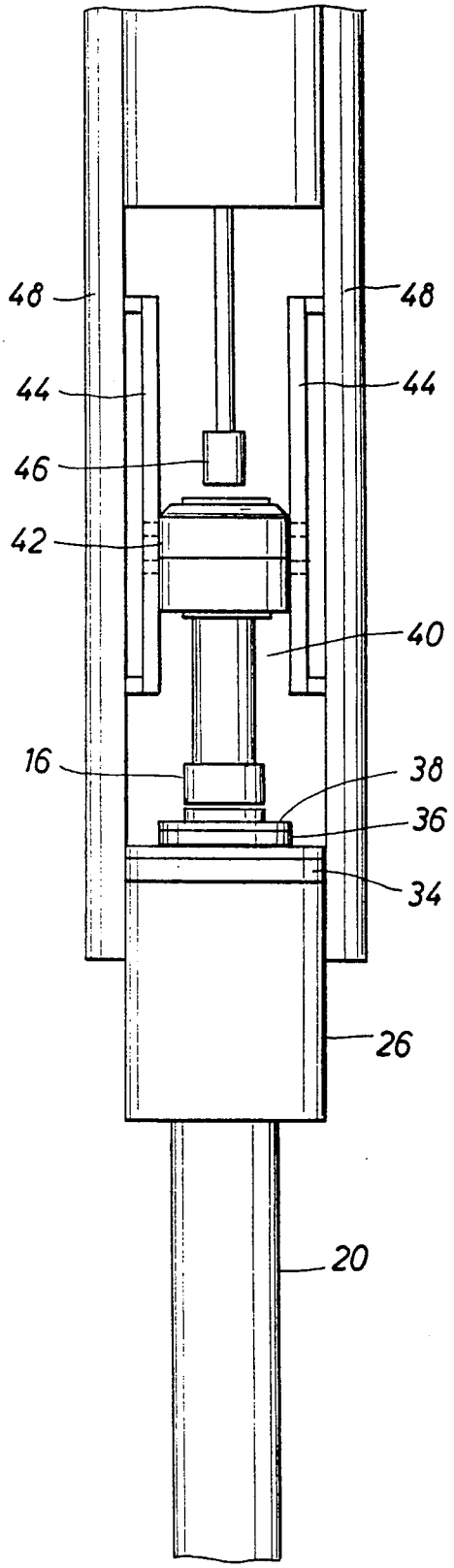
FIG. 3 illustrates a front view of the coring tool corresponding to FIG. 2.

Referring to FIGS. 2 and 3, a cross sectional side view (FIG. 2) and a front view (FIG. 3) of the sidewall coring tool 10 of FIG. 1 is illustrated, the coring motor and attached drilling bit 16 of the coring tool 10 being disposed in the original vertically disposed position.

In FIG. 2, a core storage tube 20 stores a plurality of core samples 22 which have previously been extracted from the formation 18 traversed by the wellbore 11, core samples which originated from different depths in the wellbore 11. In order to identify a particular one of the core samples 22 as having originated from a particular depth in the wellbore, a marker disc 24 is disposed between each core sample 22. As long as a marker disc 24 is disposed between each core sample 22, one can easily determine the depth in the wellbore 11 corresponding to each core sample 22. However, occasionally, a specific core sample corresponding to a specific depth in the wellbore will not be extracted from the formation and will not be stored in the core storage tube 20; if this happens, and a marker disc 24 is not disposed between each and every adjacent core sample 22 in the core storage tube 20, one cannot determine with any certainty the depth in the wellbore 11 associated with each and every other core sample 22 disposed in the core storage tube 20.

Therefore, the core sample marker system, used in association with a sidewall coring tool disposed in a wellbore, must be highly reliable, especially when used in a wellbore having severe temperature, pressure and other environmental conditions, since the absence of even one marker disc 24 between a particular adjacent set of core samples 22 can cast serious doubt on the accuracy of the recorded depth location in the wellbore associated with each and every other core sample 22 stored in the core storage tube 20.

In FIGS. 2 and 3, in accordance with one aspect of the present invention, the core storage tube 20 is threadedly connected to an actuator adaptor block 26. The actuator adaptor block 26 is made from a material of relatively high magnetic permeability, such as 17-4 PH SST, a precipitation hardening stainless steel (PH SST). The actuator adaptor block 26 is made of a material that would be considered "magnetic" but would not be considered as a "permanently magnetic" material. An internal sleeve 28 is disposed immediately above the core storage tube 20 within the actuator adaptor block 26, the internal sleeve 28 being made of a "non-magnetic" material. The purpose of the non-magnetic internal sleeve 28 is to produce an internal area within the magnetic actuator adaptor block 26 where the magnetic force is substantially reduced. In addition, a plurality of marker discs 24*a* are stored in a marker tube 30, each of the marker discs 24 and 24*a* being permanent magnets and having a high magnetic field strength. For example, the marker discs 24 and 24*a* can be comprised of Strontium Ferrite ($SrO.6Fe_2O_3$), a commercially available magnet material. The marker discs 24 and 24*a* are each made of a magnetic material which is attracted to the magnetic material of the actuator adaptor block 26. The, non-magnetic internal sleeve 28 is disposed between a first, entry section or opening 26*a* of the actuator adaptor block 26 and the top 20*a* of the core storage tube 20. The entry section or opening 26*a* of the adaptor block 26, being magnetic, attracts the magnetic marker 24*a* which is stacked in marker tube 30 thereby causing the magnetic marker 24*a* to fall into the entry section 26*a* of the adaptor block; however, the internal sleeve, being non-magnetic, allows the magnetic marker disc 24*a* to fall further into the abyss which leads to the top 20*a* of the core storage tube 20. A core pusher rod 46 pushes the marker disc 24*a* into the core storage tube 20.

A pusher spring 32 disposed within the marker tube 30 pushes the plurality of marker discs 24*a* upwardly within the marker tube. The marker tube 30 is also threadedly connected to the actuator adaptor block 26, the block 26 having a hole disposed therethrough which is co-extensive with the hole in the marker tube 30 adapted for stacking the plurality of marker discs 24*a*. A cover plate 34 is bolted to the top of the actuator adaptor 26, the cover plate 34 having a hole 34*a* disposed therethrough which is co-extensive with the hole within the internal sleeve 28.

A flexible rubber boot 36, in accordance with another aspect of the present invention, is disposed immediately above the hole 34*a* in cover plate 34. The rubber boot 36 must be made of a flexible material so that, in the event any debris is disposed between the boot 36 and the drilling bit 16, or if the core sample hangs out of the end of the boot 36, the boot can flex thus avoiding potential jamming of the core sample marker system of the sidewall coring tool of FIGS. 2–3. In addition, the boot 36 serves as a raised guard which guards against entry of debris into the hole 34*a* in the cover plate 34 which leads to the core storage tube 20. Such debris can be cuttings left over from the drilling process, pieces of rock from the wellbore, etc. If such debris falls into the core storage tube 20, problems such as marker jamming could occur. A retaining plate 38 clamps the rubber boot 36 to the cover plate 34.

The drilling bit 16 is connected to a coring motor barrel 40, which barrel 40 is adapted to retain the core sample which is retrieved from the wall 11*a* of the wellbore 11. The core motor barrel 40 is connected to the coring motor 42. The coring motor 42 and barrel 40 are physically disposed between two fixed plates 44. A side plate 48 is disposed next to in parallel with each fixed plate 44, as best shown in FIG. 3, the side plates 48 functioning as mounting apparatus for the fixed plates 44 and to join the upper and lower sections of the tool. A J-slot track 44*a* is disposed through each fixed plate 44. A pin connected to each side of the coring motor 42 is disposed through each J-slot track 44*a* in each fixed plate 44 enabling the coring motor 42, coring motor barrel 40 and drilling bit 16 to rotate from the vertically oriented position shown in FIG. 2 to a horizontally oriented position shown in FIG. 1 thereby further enabling the drilling bit 16 to drill into the formation 18, as shown in FIG. 1, and retrieve a core sample of the formation 18. The core sample, thus retrieved from the formation 18, is stored in the coring motor barrel 40. The coring motor 42, coring motor barrel 40 containing the core sample, and drilling bit 16 are then rotated from the horizontally oriented position of FIG. 1 to the vertically oriented position of FIG. 2. A core pusher rod 46 then pushes the core sample out of the coring motor barrel 40, through the rubber boot 36, into the internal sleeve 28, and into the core storage tube 20. FIG. 2 illustrates two such core samples 22 already stored in the core storage tube 20, a magnetic marker disc 24 being disposed between each core sample 22 in FIG. 2.

Figure 4:
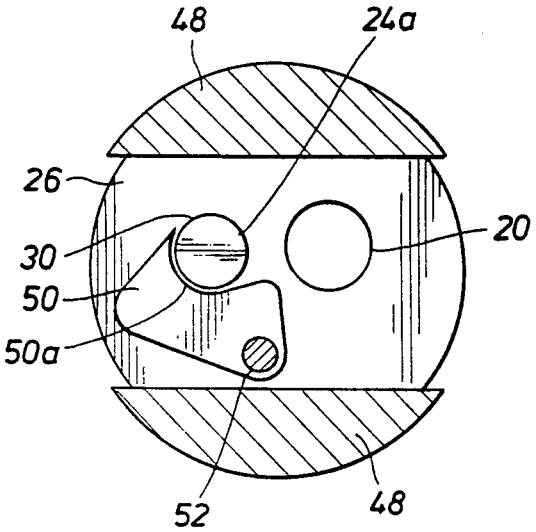
FIG. 4 illustrates a cross section of FIG. 2 taken along section lines A—A of FIG. 2, this cross section being a top view illustrating the marker kicker, the top of the core marker tube, and the column of magnetic markers in the marker tube at an instant in time before the marker kicker sweeps or kicks the marker from the marker tube position.
Figure 5:
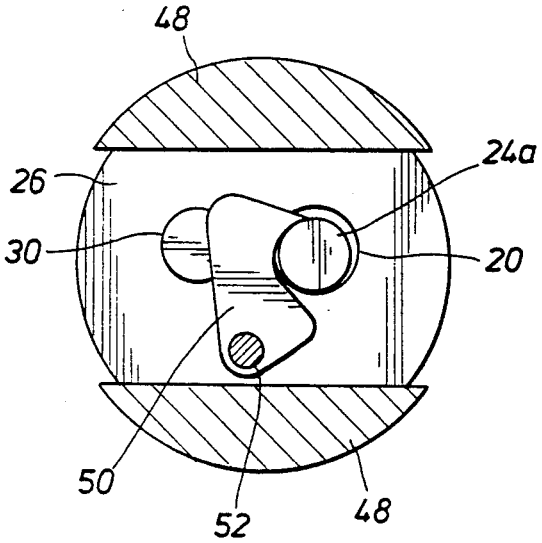
FIG. 5 also illustrates a cross section of FIG. 2 taken along section lines A—A of FIG. 2, this cross section also being a top view similar to FIG. 4 at another instant in time after the marker kicker has swept or kicked the marker from the marker tube position to a location disposed at the top of the core storage tube.

Referring to FIGS. 4 and 5, a top cross-sectional view of the sidewall coring tool of FIG. 2, taken along section lines 4—4 of FIG. 2, is illustrated.

In FIG. 4, the side plates 48 are shown disposed adjacent to the magnetic actuator adaptor 26. The magnetic marker discs 24*a* are shown stacked in the marker tube 30. The core storage tube 20 is disposed directly adjacent the marker tube 30. A rotating plate 50 is shown hinged to a oscillating actuator shaft 52, the rotating plate 50 having a serpentine shape, at 50*a*, for retaining one of the magnetic marker discs 24*a*. The rotating plate 50 moves from its position shown in FIG. 4 to its position shown in FIG. 5 in response to the oscillating motion of actuator shaft 52.

The cover plate 34, rotating plate 50, core storage tube 20, and internal sleeve 28 are all made from a suitable material of low magnetic permeability, such that it is considered "non-magnetic"; an example of such a suitable material is 18-8 SST, an austenitic stainless steel.

In FIG. 5, the rotating plate 50 moved from its position shown in FIG. 4 to the position shown in FIG. 5 in response to the oscillating movement of the actuator shaft 52; and, as a result, the magnetic marker discs 24*a* moved from their stacked position within marker tube 30 to a hole defined to be an opening to the core storage tube 20.

In accordance with one aspect of the present invention, recall that the marker discs 24*a* are made of a permanently magnetic material, and that the actuator adaptor 26 is also made of a magnetic (although non-permanently magnetic) material; however, the cover plate 34, rotating plate 50, core storage tube 20, and internal sleeve 28 are all made from a suitable non-magnetic material of low magnetic permeability. As a result, in accordance with one major aspect of the present invention, each of the marker discs 24*a* will automatically be drawn into the first entry section or opening 26*a* of the magnetic actuator adaptor 26 regardless of the deviation of the wellbore in which sidewall coring tool of FIGS. 1–5 is disposed. In addition, since the internal sleeve 28 is made of a non-magnetic material, the core pusher rod 46 will easily be able to push the marker disc 24*a* from the internal sleeve 28 into the core storage tube 20.

A functional description of the operation of the sidewall coring tool of FIGS. 1–5 (including the magnetic marker discs 24*a*, magnetic actuator adaptor 26, and non-magnetic internal sleeve 28 in accordance with the present invention) will be set forth in the following paragraphs with reference to FIGS. 6–8 of the drawings.

The rotating plate 50 sweeps the marker disc 24*a* from its position within marker tube 30 to an opening 26*a* in the actuator adaptor 26 which leads to the core storage tube 20.

It is absolutely essential that the marker disc 24*a* enter the opening 26*a* and enter the core storage tube 20 before the core sample is pushed out of the barrel 40, since, if the marker disc 24*a* fails to enter the opening 26*a*, the core sample in barrel 40 will be pushed out of barrel 40 and into the core storage tube 20 and there will be no marker disc separating the two adjacent core samples. As a result, there can be no certainty with regard to the accuracy of the depth in the wellbore associated with each core sample disposed in the core storage tube 20.

However, in accordance with one major aspect of the present invention, since the marker discs 24*a* are made of a permanently magnetic material which is attracted to the actuator adaptor 26 (also made of a magnetic although non-permanently magnetic material), but the cover plate 34, the rotating plate 50 of FIGS. 4–5, the core storage tube 20, and the internal sleeve 28 are all made of a non-magnetic material of low magnetic permeability, each of the marker discs 24*a* stacked in marker tube 30 will automatically be attracted to and drawn into the entry section or opening 26*a* of the magnetic actuator adaptor 26 regardless of the deviation of the wellbore in which sidewall coring tool is disposed. The internal sleeve 28, being nonmagnetic, will reduce the magnetic attraction enough to allow the marker disc 24*a*, disposed in opening 26*a*, to fall into the abyss which leads to the top 20*a* of the core storage tube 20.

Following the kicking of the magnetic marker 24*a*, the core drilling operation takes place. The coring motor 42 moves out along the J-slot track 44*a* in the fixed plate 44 towards the rock formation. The side plates 48 act as a mounting apparatus for the fixed plates 44 and also join the upper and lower sections of the tool. The coring motor barrel 40 which has attached to its end a coring drilling bit 16 spins as directed from the surface equipment. The drilling bit 16 and motor 42 are pushed into the formation and the bit 16 penetrates into the formation. When the motor 42 reaches the end of its travel in the J-slot 44*a*, the fixed plates 44 are pulled up so as to break off the core sample.

Figure 6:
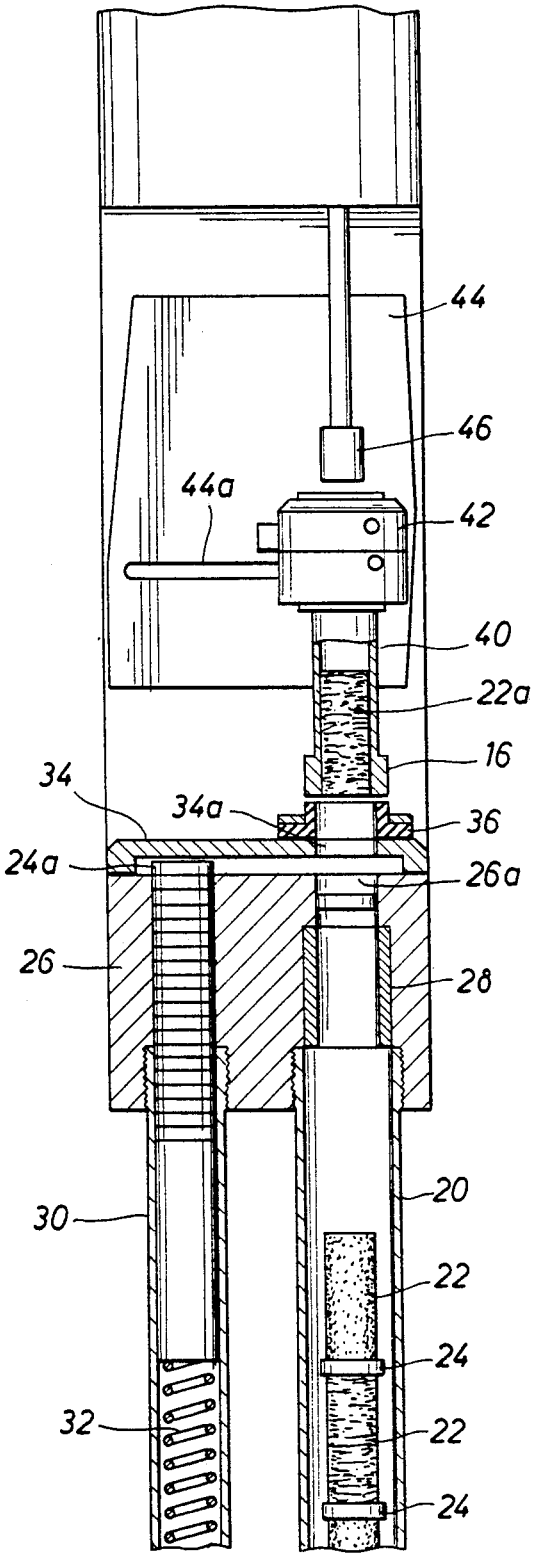
FIG. 6 illustrates the coring motor and bit including the retrieved core after the core has been broken off and the coring motor has swung back into the vertical position.
Figure 7:
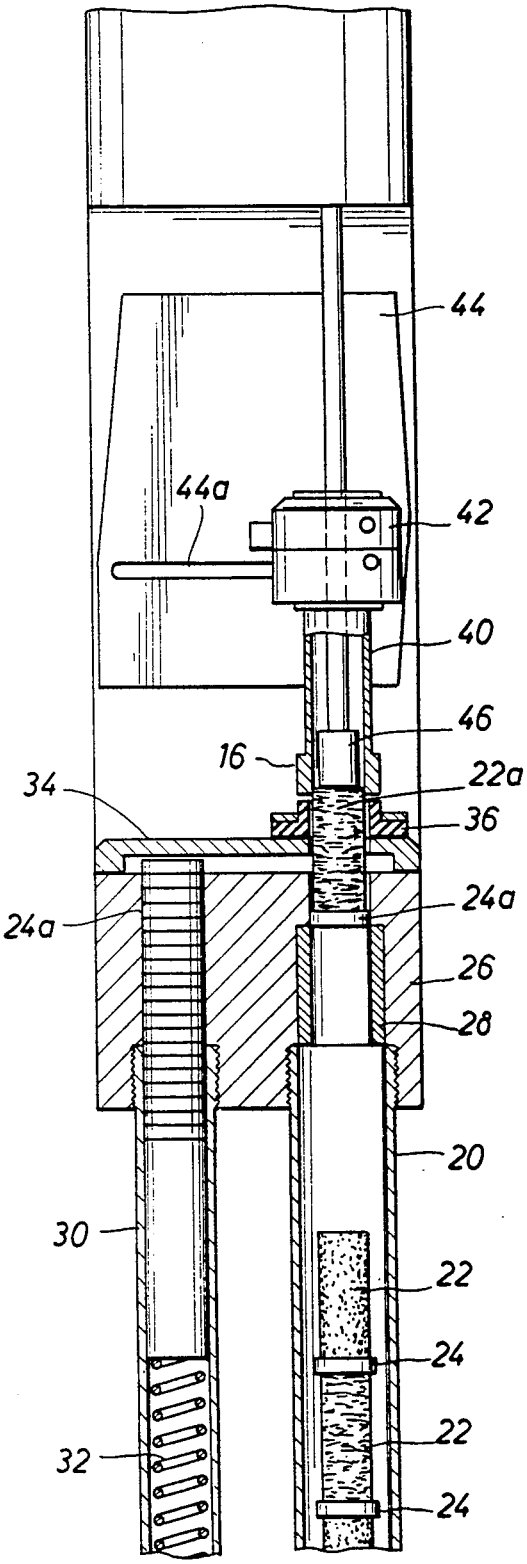
FIG. 7 illustrates the mid-stroke position of the core pusher rod, the core pushing the magnetic marker disc down towards the core storage tube, the magnetic marker disc entering the non-magnetic sleeve.
Figure 8:
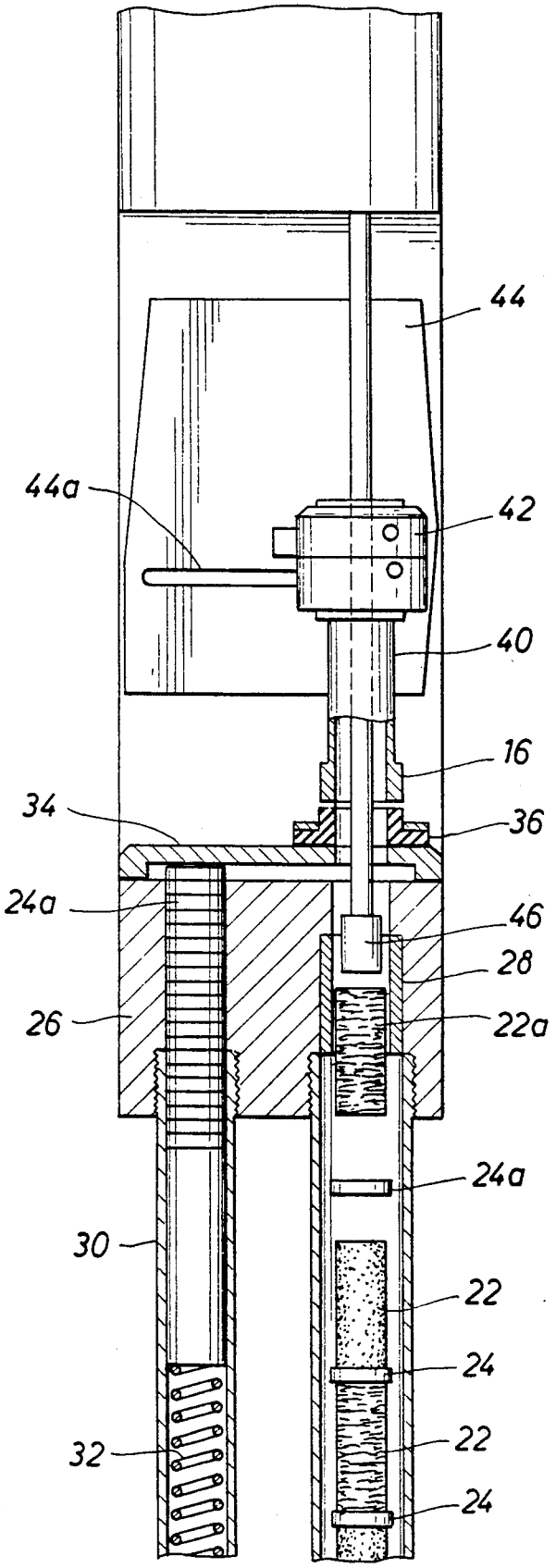
FIG. 8 illustrates the core pusher rod at the end of its stroke, the magnetic marker disc having fallen out of the non-magnetic sleeve and the core being pushed towards the core storage tube.

In FIGS. 6–8, the motor 42, barrel 40, and bit 16 are retracted into a vertical position; the retrieved core 22*a* is held in the barrel 40. The core sample is being pushed out of the barrel 40 into the core storage tube 20. To move the sidewall core sample to the core storage tube 20, the core pusher rod 46, which is hydraulically actuated and can push with substantial force, moves down through the core barrel 40 and contacts the core 22*a*, pushing it through a hole 34*a* in the cover plate 34 and into the actuator adapter 26, as seen in FIG. 7. The core sample is pushed into contact with the marker 24*a* which now resides within the actuator adapter 26. The core pusher rod 46 continues to push the marker 24*a* and sidewall core sample down. The marker 24*a* is pushed into the internal area of the non-magnetic internal sleeve 28, as seen in FIG. 7. When this occurs, the magnetic force that is holding the magnetic marker disc 24*a* inside the actuator adaptor block 26 becomes very small; therefore, the marker disc 24*a* is free to fall into the core storage tube 20, which is the desired effect. If the marker does not fall (as would be the case when the tool is horizontal and no gravitational force is pulling the marker 24*a* into the storage tube 20), its resistance to being pushed by pusher rod 46 will be reduced and marker disc 24*a* will be pushed into the core storage area 20 along with the core. Previously cut and stored cores 22 are shown stacked in the core storage tube 20 with the magnetic markers discs 24 in their correct positions. At this point, the cycle has ended and the core pusher rod 46 remains in the fully extended position to prevent cores from coming back up and out of the core storage tube 20. The entire cycle as described above can be repeated to obtain another core if desired.

Figure 9:
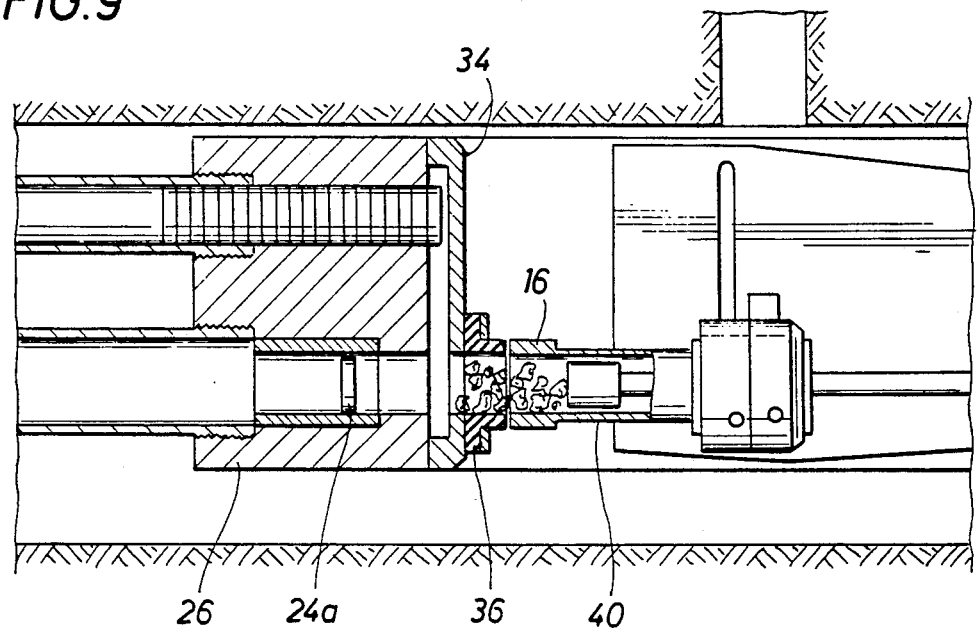
FIG. 9 illustrates the coring tool mechanism in the horizontal position with the core pusher rod pushing a fragmented core into the actuator adapter towards the core storage tube.
Figure 10:
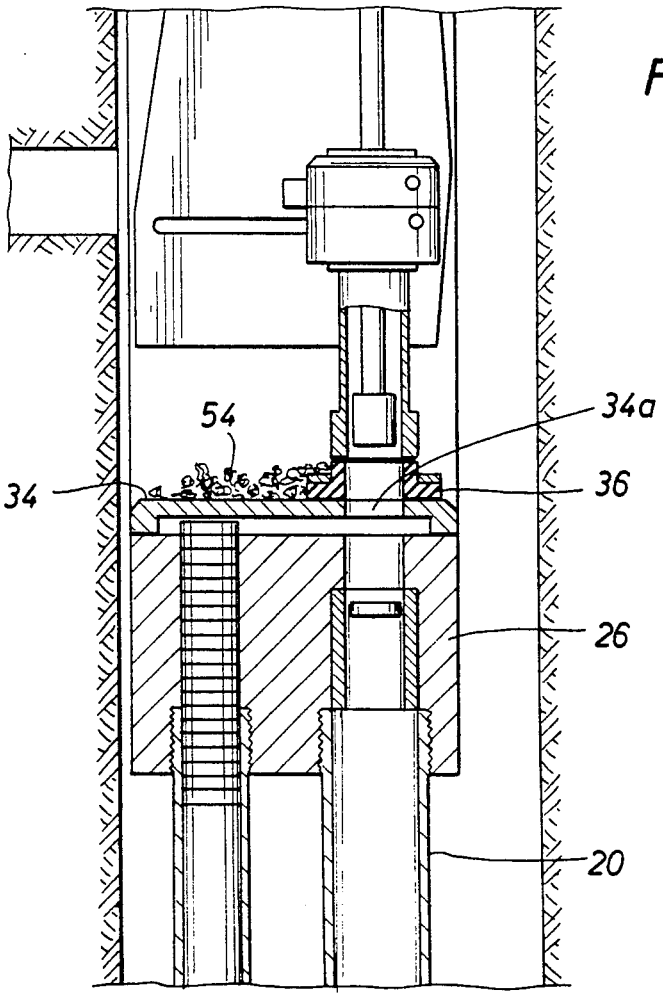
FIG. 10 illustrates the coring tool mechanism in a vertical position with the flexible rubber boot preventing debris from entering the opening leading to the core storage tube.

Referring to FIGS. 9 and 10, the sidewall coring tool is shown in FIG. 9 in a horizontal wellbore with the core pusher rod 46 pushing a fragmented core into the actuator adaptor 26 toward the core storage tube 20, and the sidewall coring tool is shown in FIG. 10 in a vertical position with the flexible boot 36 preventing debris from entering the opening leading to the core storage tube 20.

In accordance with another aspect of the present invention, the flexible boot 36 acts as an extension of the actuator adapter 26 and the core receiver tube. The boot 36 is fastened to the cover plate 34 by screws and a retaining plate 38. The retaining plate 38 holds down all sides of the boot 36. The flexible boot 36 serves two purposes.

In FIG. 9, the first function of the boot 36 is to act as a guide from the core barrel 40 and bit 16 into the actuator adapter 26 and core receiver tube. The boot 36 occupies the space which exists between the top of the cover plate 34 and the end of the drilling bit 16. This means that when a core is broken or segmented, all of the pieces of the core will be guided into the core receiver tube for recovery, regardless of the tool position or angular orientation in the wellbore. The boot 36 is made from a flexible material so that if any debris gets between the boot 36 and the bit 16, or if the core sample is hanging out of the end of the boot, the boot 36 can flex out of the way, thus avoiding potential jamming.

In FIG. 10, the second function of the boot 36 is to serve as a raised guard against debris, such as debris 54 in FIG. 10, which enters the hole 34*a* in the cover plate 34 which leads to the actuator adapter 26 and ultimately the core storage tube 20. Debris can originate from cuttings left over from the drilling process, cuttings from the sidewall core drilling process, and pieces of rock knocked from the borehole wall as the coring tool moves past. This debris accumulates on the cover plate 34 and falls into the core storage tube 20 causing problems such as marker jamming and occupying space in the core receiver tube that could otherwise be used for core storage. This is important because the tool operator has a limited amount of storage space and needs to be able to rely on having a known volume in which to store core samples.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A sidewall coring tool adapted to be disposed in a wellbore for retrieving core samples from a wall of said wellbore and storing said core samples in a core storage tube, comprising:

core marking means for separating successive ones of the core samples retrieved from said wall of said wellbore and storing the separated core samples in said core storage tube, said core marking means including, marker means comprised of a first magnetic material for separating said successive ones of the core samples when said core samples are stored in said core storage tube, and block means comprised of a second magnetic material which is magnetically attracted to said first magnetic material and connected to said core storage tube for magnetically attracting said marker means to said core storage tube, the marker means being inserted between said successive ones of the core samples in said core storage tube thereby separating the core samples.

2. The sidewall coring tool of claim 1, wherein said block means includes a hole disposed therethrough, said hole being coextensively disposed with respect to said core storage tube when said block means is connected to said core storage tube, said marker means entering said hole when magnetically attracted to said block means.

3. The sidewall coring tool of claim 2, wherein said block means includes an entry section comprised of said second magnetic material and defining a portion of said hole, said entry section being adapted to initially receive said marker means when said marker means enters said hole.

4. The sidewall coring tool of claim 3, further comprising non-magnetic sleeve means connected between said entry section of said block means and said core storage tube and defining a further portion of said hole in said block means for reducing a magnetic attraction between said marker means and said block means thereby allowing said marker means to fall into said core storage tube.

5. The sidewall coring tool of claim 4, further comprising:

marker tube means for storing a plurality of said marker means, said core marking means including kicker means for kicking successive ones of said marker means from said marker tube means into the portion of said hole defined by said entry section of said block means, said marker means being initially magnetically attracted to said second magnetic material of said entry section of said block means when said kicker means kicks said marker means into said entry section, the magnetic attraction being subsequently reduced when said marker means enters said sleeve means.

6. The sidewall coring tool of claim 5, further comprising:

coring motor means including a coring motor barrel for rotating said barrel and retrieving said core sample from said wall of said wellbore, said coring motor means and said barrel adapted to rotate between a vertical position and a horizontal position; and boot means comprised of a flexible material and disposed between said entry section of said block means and said barrel when said coring motor means is disposed in said vertical position for creating a continuous tube between said barrel of said coring motor means and said hole in said block means when said coring motor means is disposed in said vertical position.

7. A method of marking a core sample retrieved by a sidewall coring tool disposed in a wellbore, comprising the steps of:

storing said core sample in a core storage tube;

kicking a magnetic marker disc from a marker tube into a hole in a magnetic adaptor block, the magnetic marker disc being magnetically attracted to said hole in said magnetic adaptor block, said marker disc marking said core sample.

8. The method of claim 7, further comprising the steps of:

reducing the magnetic attraction between said magnetic marker disc and said magnetic adaptor block after said marker disc enters said hole in said adaptor block, the marker disc falling into said core storage tube when the magnetic attraction is reduced.

9. Apparatus for marking a core sample retrieved by a sidewall coring tool disposed in a wellbore, comprising:

storage means for storing said core sample; and kicker means for kicking a marker disc comprised of a first magnetic material into a hole in an adaptor block comprised of a second magnetic material, the second magnetic material of said adaptor block magnetically attracting said first magnetic material of said marker disc, said marker disc falling into said storage means and marking said core sample after said marker disc enters said hole in said adaptor block.

10. The apparatus of claim 9, further comprising:

means disposed within said hole in said adaptor block for reducing the magnetic attraction between said adaptor block and said marker disc after said marker disc enters said hole in said adaptor block.

11. A sidewall coring tool adapted to be disposed in a wellbore for obtaining a core sample of a formation traversed by said wellbore, comprising:

a coring motor including a barrel adapted to rotate from a vertical position to a horizontal position, the core sample being obtained by the coring motor and stored in said barrel when the coring motor is disposed in the horizontal position;

a core storage tube for storing the core samples when said samples are obtained by the coring motor; and a boot disposed between the core storage tube and the barrel of the coring motor when said coring motor is disposed in the vertical position and sealing the barrel of the coring motor to the core storage tube when the coring motor is disposed in the vertical position for creating a continuous tube effect, the continuous tube effect extending from the barrel of the coring motor to the core storage tube.

12. The sidewall coring tool of claim 11, wherein the boot is comprised of a flexible material.

13. The sidewall coring tool of claim 12, wherein the boot is comprised of a rubber-like material.

14. The sidewall coring tool of claim 11, further comprising:

core marking means for marking said core sample obtained by said coring motor, said core marking means including, a marker disc comprised of a first magnetic material;

an adaptor block comprised of a second magnetic material, said second magnetic material of said adaptor block being magnetically attracted to said first magnetic material of said marker disc; and kicker means for kicking said marker disc into a hole in said adaptor block which leads to said core storage tube, the marker disc being magnetically attracted to said hole in said adaptor block, said marker disc falling into said core storage tube and marking said core sample disposed therein after said marker disc is magnetically attracted to said hole in said adaptor block.

15. The sidewall coring tool of claim 14, further comprising:

means disposed in said hole in said adaptor block for reducing the magnetic attraction of said first magnetic material of said marker disc to said second magnetic material of said adaptor block, said marker disc being initially magnetically attracted to said adaptor block but subsequently falling into said core storage tube in response to the reduced magnetic attraction produced by the means for reducing.

16. A sidewall coring tool adapted to be disposed in a wellbore, comprising:

a plurality of markers comprised of a second magnetic material;

an adaptor block comprised of a first magnetic material, said adaptor block including a first means for storing said plurality of markers and a second means for storing a plurality of core samples, the second magnetic material of each of said plurality of makers being magnetically attracted to the first magnetic material of said adaptor block.

17. The sidewall coring tool of claim 16, wherein said second means includes a first part forming a part of said adaptor block and comprised of said first magnetic material and a second part substantially coextensively disposed below said first part and comprised of a non-magnetic material.

18. The sidewall coring tool of claim 17, wherein said second part comprises a non-magnetic internal sleeve.

19. The sidewall coring tool of claim 17, further comprising:

means for kicking each of said plurality of markers from said first means to said first part of said second means when a first one of said plurality of core samples is stored in said second means, each of said markers being held in said first part of said second means by the magnetic attraction existing between the second magnetic material of said markers and the first magnetic material of said adaptor block.

20. The sidewall coring tool of claim 17, wherein said second means further includes a flexible boot substantially coextensively disposed above said first part of said second means thereby sealing said first part of said second means from an external environment.

21. The sidewall coring tool of claim 20, further comprising:

means for kicking each of said plurality of markers from said first means to said first part of said second means when a first one of said plurality of core samples is stored in said second means, each of said markers being held in said first part of said second means by the magnetic attraction existing between the second magnetic material of said markers and the first magnetic material of said adaptor block.

* * * * *